US007643603B2

(12) United States Patent
Miranda et al.

(10) Patent No.: US 7,643,603 B2
(45) Date of Patent: Jan. 5, 2010

(54) AUTOMATIC PROCESS COUNTER

(75) Inventors: Michael Angelo P. Miranda, Bulacan (PH); Marvin C. Tenio, New South Wales (AU)

(73) Assignee: Hitachi Global Storage Technologies, Netherlands B.V., Amsterdam (NL)

( * ) Notice: Subject to any disclaimer, the term of this patent is extended or adjusted under 35 U.S.C. 154(b) by 130 days.

(21) Appl. No.: 12/069,682

(22) Filed: Feb. 11, 2008

(65) Prior Publication Data

US 2009/0202032 A1 Aug. 13, 2009

(51) Int. Cl.
*G07C 3/00* (2006.01)
*G06M 11/00* (2006.01)

(52) U.S. Cl. ..... 377/15; 377/6; 377/12

(58) Field of Classification Search ..... None
See application file for complete search history.

(56) References Cited

U.S. PATENT DOCUMENTS

| | | | | |
|---|---|---|---|---|
| 3,987,533 | A | 10/1976 | Sandgren | |
| 5,341,304 | A | 8/1994 | Sakamoto et al. | |
| 6,571,179 | B2 | 5/2003 | Siegel | |
| 6,685,350 | B2 | 2/2004 | Esser et al. | |
| 6,954,048 | B2 | 10/2005 | Cho | |
| 7,137,541 | B2 | 11/2006 | Baskar et al. | |
| 2008/0141041 | A1 * | 6/2008 | Molaro et al. | 713/193 |

FOREIGN PATENT DOCUMENTS

| | | |
|---|---|---|
| JP | 09155753 | 6/1997 |
| WO | WO-2004/029466 | 4/2004 |

OTHER PUBLICATIONS

Asg, et al., "TS III Qualifier Operation Manuel", *ASG, Division of Jergens Inc.*, (Jan. 2005),1-52.
Chicago Pneumatic, et al., "Fastening Assurance System", www.chicagoneumatic.com, (2007),1-3.
Nitto, et al., "Electric Screwdrivers: delvo", *Nitto Kohki Co., LTD.*, (2006),1-27.
Ise, Inc., et al., "Series 376 Product Highlights", http://instserv.com, (2006),109-112.
Universal Process, et al., "Operating Manuel for Models:4001/4011/5001/5011/5600/8001/5001-T/8001-T", (Jul. 4, 2004),1-20.

* cited by examiner

*Primary Examiner*—Tuan Lam

(57) ABSTRACT

The present invention provides an automatic process counter that detects electrical signals from fasteners and attachments fastened to devices in a hard disk drive manufacturing line and uses the signals to increment the count of the fastens. Count signals are then transmitted to a plurality of display units for visual display to monitoring operators in the manufacturing line.

21 Claims, 5 Drawing Sheets

AUTOMATIC PROCESS COUNTER

TECHNICAL FIELD

The present invention relates generally to a method and a system for manufacturing and fabricating hard drive components in a manufacturing environment, and more particularly, to a system and process for automatically counting process fasteners in components during manufacturing.

BACKGROUND ART

In many processing and computing systems, magnetic data storage devices, such as disk drives are utilized for storing data. A typical disk drive includes a spindle motor having a rotor for rotating one or more data disks having data storage surfaces, and an actuator for moving a head carrier arm that supports transducer (read/write) heads, radially across the data disks to write data to or read data from concentric data tracks on the data disk.

In the manufacturing of the disk drive, many processes are utilized to manufacture components. Over the years, manufacturing processes have become more automated. Where repeated processes are required, such as machining, fastening or riveting, the use of automation has enhanced productivity and improved quality control by greatly reducing human error in the manufacturing process. However, in many cases, manual control is often necessary to initiate or terminate a process to change out tooling and equipment.

Standardization of repeat operations is a primary feature of automation, though automation of manufacturing processes may take many forms and can be done at almost any phase of the process, from fabrication to inspection and packaging of a completed product. In true automation, the process or step being automated involves a sensing system for making decision about device or process and then a control system that reacts to the sensed information and provides control reaction.

Manufacturing systems are also becoming more integrated. Workers involved in the manufacturing process, by controlling and operating the machinery on the assembly floor are gaining greater efficiencies. However, despite these improvements, deficiencies are still encountered, especially in the manufacturing of small components requiring several fastening processes. The miniaturization of these components leaves the counting of, for example, fasteners to the operator. This contributes to errors and disruption in the assembly line when these errors have to be fixed.

Therefore, what is need is a flexible way of fastening components and automatically counting the fastener during the fabrication and manufacturing of hard disk drives by providing a wider visibility of the counting and alarm indicators to a larger group of operators in the assembly environment.

SUMMARY

In accordance with certain aspects of the present invention, there is provided a system and method for monitoring process counting in the fabrication of components and sub-component of a hard disk drive in the assembly environment in the fabrication and manufacture of hard disk drive components.

In one embodiment, an automatic process counting monitoring system of the present invention provides a component fastening or component attachment tool for fastening or attaching fasteners to the component or sub-components being fabricated. In one embodiment, the fastening tool integrates a sensor that is capable of sensing the fastening or attaching of the fasteners to the various constituents of the components being fabricated. The sensor may also be remotely located in the assembly floor in a location where the finished fabricated component may be automatically inspected to determine whether the requisite number of fasteners or attachments are present.

In one embodiment, the automatic process counting monitoring system further comprises a process counting sequencing module that counts in real time the number of fasteners or attachments present in a particular process. The automatic process counting sequencing module receives electronic signals from any process or device indicating fastening or attachment completion of the fasteners or attachments to the components being fabricated. In one embodiment, the automatic process counting sequencing module simultaneously monitors multiple processes to count the fasteners being used in each process. In one embodiment, the process counting sequencing module includes a process specification unit that stores the fastening or attachment information for multiple processes for components to be fabricated for a particular hard disk device. The process specification unit is utilized by the process counting sequencing module to count the fasteners or attachments of multiple components at the same time.

In one embodiment, the automatic process counting monitoring system further comprises a plurality of reset devices to enable operators in the manufacturing line to reset the count in any of the plurality of process counters in the event of an error in a particular count. The reset device is reset when an alarm device is trigger to indicate an under-count or an over-count of the fasteners or attachments to a component or sub-component being monitored.

BRIEF DESCRIPTION OF THE DRAWINGS

The accompanying drawings, which are incorporated in and constitute a part of the specification, illustrate embodiments of the invention, and together with the general description given above and the detailed description given below serve to explain the teachings of the invention.

BEST MODES FOR CARRYING OUT THE INVENTION

Reference will now be made in detail to the alternative embodiment(s) of the present invention. While the invention will be described in conjunction with the alternative embodiment(s), it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

The discussion will begin with an overview of a hard disk drive and components connected therewith. The discussion will then focus on embodiments of a method and system for automatically counting fastener or attachments used in assembling components during the manufacturing of the hard disk drive in a disk drive assembly environment. The invention further provides a remote process counting monitoring system to detect when required fasteners or attachments to component or sub-component being manufactured are under-counted or over-counted during the manufacturing of the hard disk drive.

Overview

In general, the HDD comb (also referred to as an E-block) serves as a platform on which the suspensions (compliant members containing sliders with recording heads) are mounted. The recording heads fly at a constant height (on the order of nanometers) above the disk surface tracking pre-written servo information. An HDD carriage assembly (as shown in FIG. 1) forms the primary motive mechanical system that enables a disk-drive to randomly access data to be written or recorded on the disk surfaces.

Figure 1:
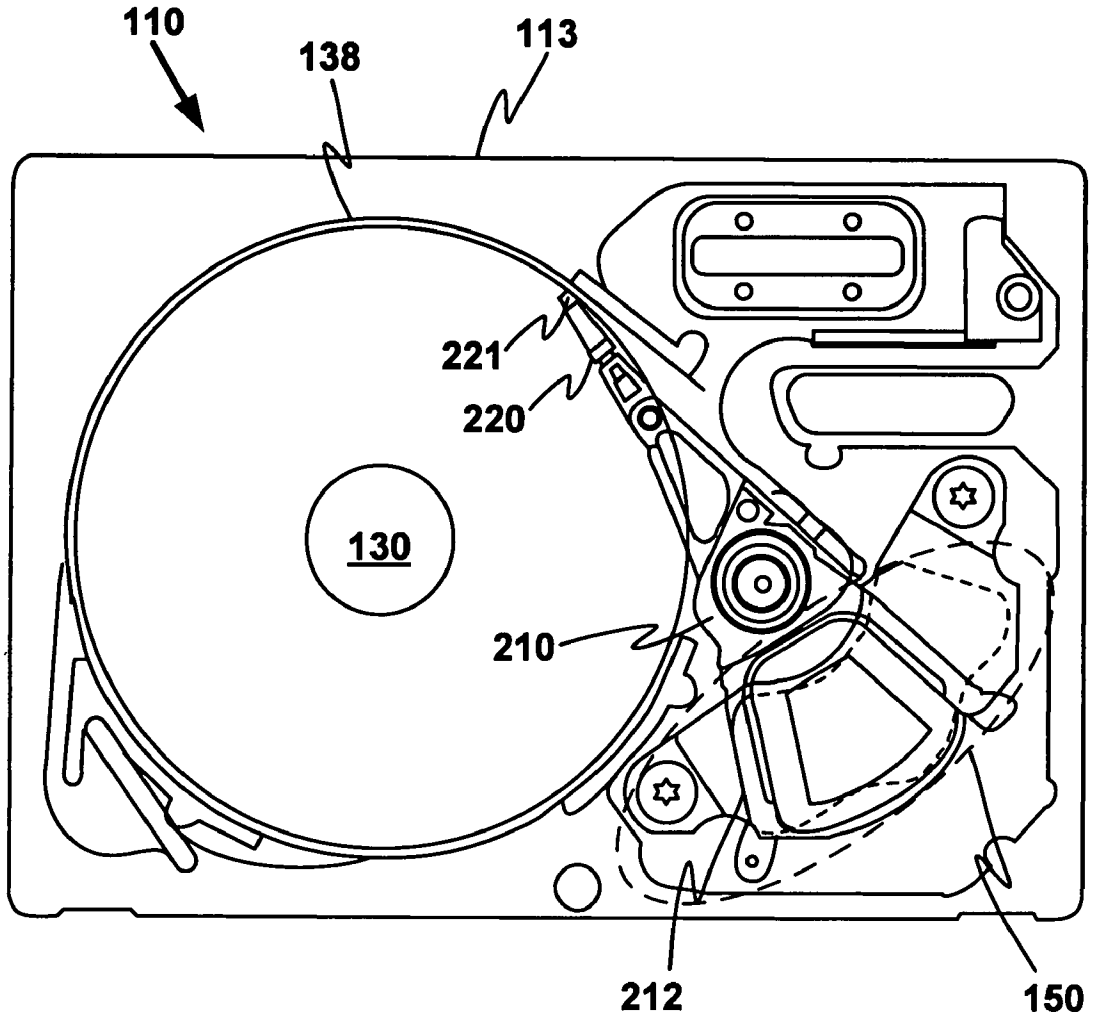
FIG. 1 is a plan view of an HDD in accordance with one embodiment of the present invention.

With reference now to FIG. 1, a schematic drawing of one embodiment of an information storage system including a magnetic hard disk file or HDD 110 for a computer system is shown, although only one head and one disk surface combination are shown. What is described herein for one head-disk combination is also applicable to multiple head-disk combinations. In other words, the present technology is independent of the number of head-disk combinations.

In general, HDD 110 has an outer housing 113 usually including a base portion (shown) and a top or cover (not shown). In one embodiment, housing 113 contains a disk pack having at least one media or magnetic disk 138. The disk pack (as represented by disk 138) defines an axis of rotation and a radial direction relative to the axis in which the disk pack is rotatable.

A spindle motor assembly having a central drive hub 130 operates as the axis and rotates the disk 138 or disks of the disk pack in the radial direction relative to housing 113. An actuator assembly 125 includes one or more actuator arms 210. When a number of actuator arms 210 are present, they are usually represented in the form of a comb that is movably or pivotally mounted to base/housing 113. A controller 150 is also mounted to base 113 for selectively moving the actuator arms 210 relative to the disk 138. Actuator assembly 140 may be coupled with a connector assembly, such as a flex cable to convey data between arm electronics and a host system, such as a computer, wherein HDD 110 resides.

In one embodiment, each actuator arm 210 has extending from it at least one cantilevered integrated lead suspension (ILS) 220. The ILS 224 may be any form of lead suspension that can be used in a data access storage device. The level of integration containing the slider 221, ILS 224, and read/write head is called the Head Gimbal Assembly (HGA).

The ILS 224 has a spring-like quality, which biases or presses the air-bearing surface of slider 221 against disk 138 to cause slider 221 to fly at a precise distance from disk 138. ILS 224 has a hinge area that provides for the spring-like quality, and a flexing cable-type interconnect that supports read and write traces and electrical connections through the hinge area. A voice coil 212, free to move within a conventional voice coil motor magnet assembly is also mounted to actuator arms 210 opposite the head gimbal assemblies. Movement of the actuator assembly 210 by controller 150 causes the head gimbal assembly to move along radial arcs across tracks on the surface of disk 138.

Figure 2:
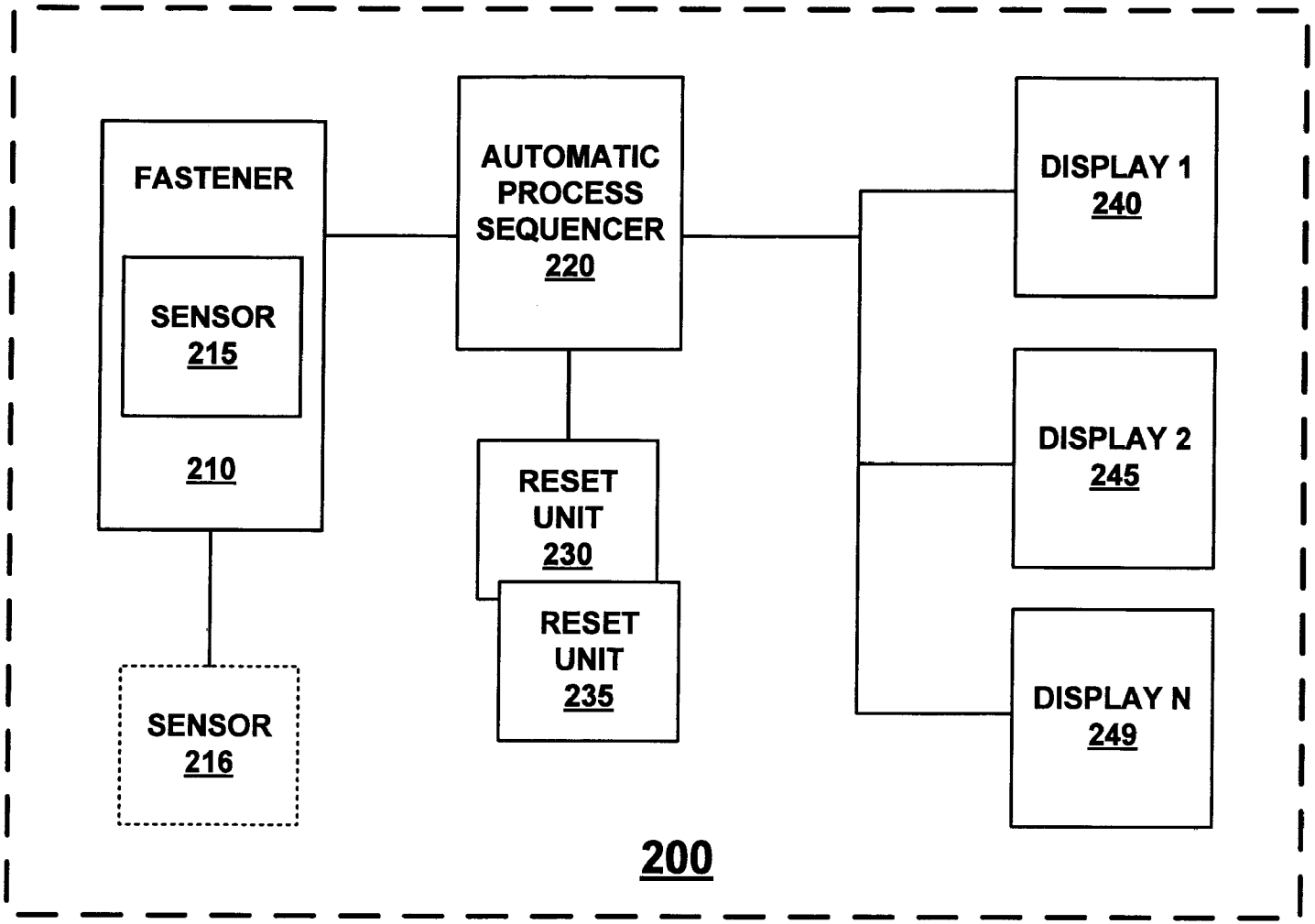
FIG. 2 is a block diagram illustration of one embodiment of the Automatic process counting monitoring system of the present invention.

With reference now to FIG. 2 is shown an exemplary block diagram of an automatic process counting monitoring system 200 of one embodiment of the present invention. As depicted in FIG. 2 the process counting monitoring system 200 comprises a fasten device tool 210, an automatic process sequencer 220, a plurality of reset units 230 and a plurality of display units 240-249. In one embodiment, the fasten device tool 210 is integrated with a sensor 215. IN another embodiment the sensor remote from the fasten device tool 210 as illustrated by sensor 216.

In one embodiment of the invention, the fasten device tool 210 sense and records fastener or attachment information utilized in fabricating components or sub-component in the manufacturing of hard disk drives. The recorded information is transmitted as electrical signals which are relayed to the automatic process sequencer 220.

The automatic process sequencer 220 processes the received signals by incrementing a count for each fastener or attachment attached to a component or sub-component for the process being monitored. In one embodiment, the automatic process sequencer 220 senses the electrical signals from predefined devices used in the fabricating process of a particular component. The count signals are then displayed in the plurality of display devices 240-249. In one embodiment, the automatic process sequencer 220 is programmable to keep track of the set value and the limit value of each process monitored. In one embodiment, the software used in programming the automatic process sequencer 220 is a ladder diagram programming software.

In one embodiment of the present invention, the display devices 240-249 are capable of simultaneously displaying the count information of one or more components being monitored to multiple locations in the manufacturing line for monitoring by multiple operators. The remote plurality of reset units 230 are also located in multiple locations in the manufacturing line to allow operators to reset the count of a particular process if an error is detected in a present count.

In one embodiment of the automatic process counting monitoring system 200, the sensor 216 is not integrated in the fasten device tool 210 and may be located at exit paths of the manufacturing line of the components being fabricated. In the configuration, the sensor 210 senses the fasteners or attachments in a particular component and communicates electrical signals from these fasteners or attachments to the automatic process sequencer to count number of fasteners or attachments in the component.

Figure 3:
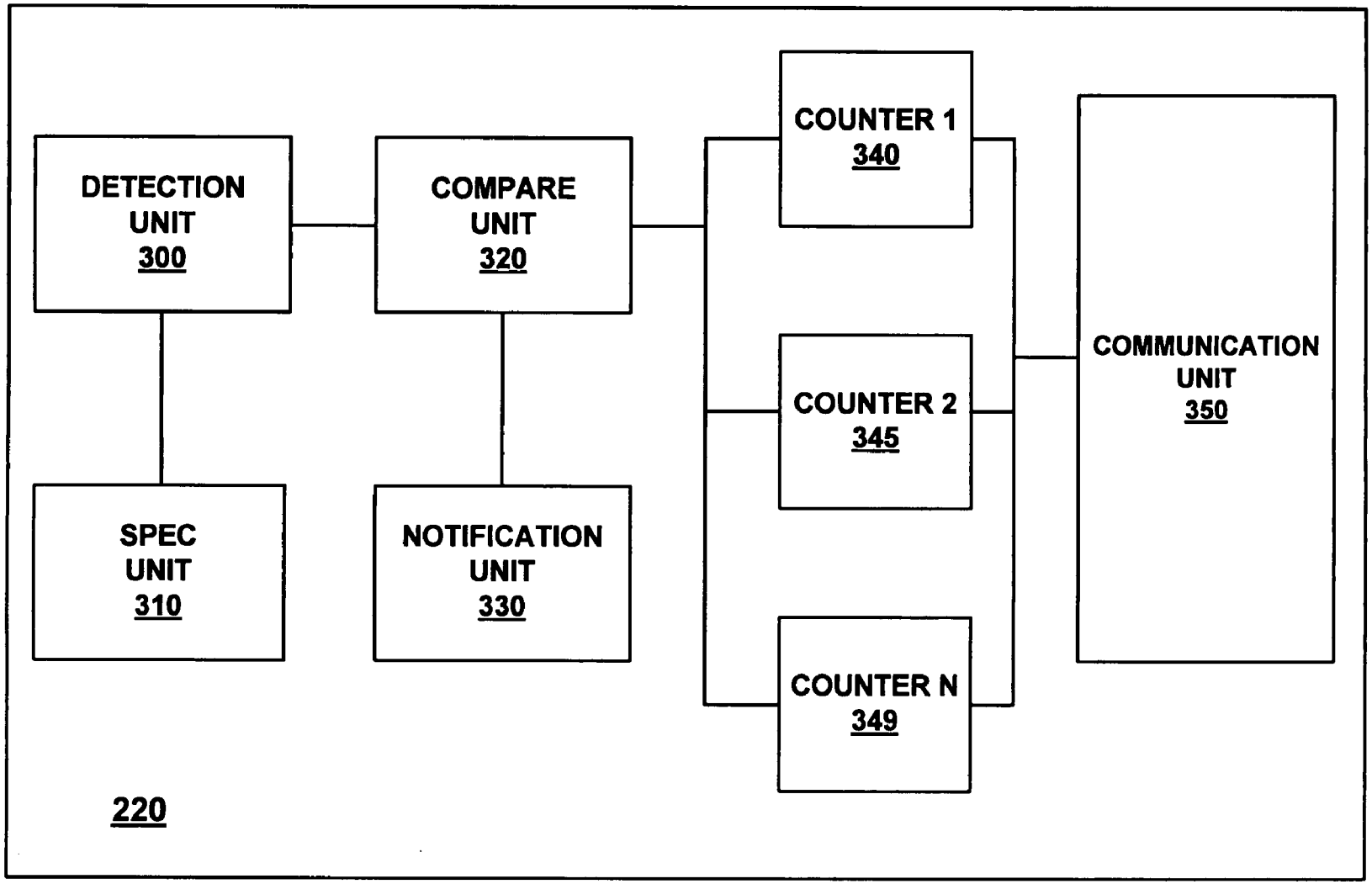
FIG. 3 is a block diagram illustration of the automatic process counter unit according to one embodiment of the invention.

FIG. 3 is a block diagram illustration of one embodiment of the automatic process sequencer unit 220 of one embodiment of the present invention. In the exemplary embodiment shown in FIG. 3, the automatic process sequencer unit 220 comprises detection logic module 300, process specification module 310, compare module 320, alarm notification module 330, a plurality of counters 340-349 and network connection module 350.

The detection logic module 300 detects external electrical signals provided by the sensor 215 or 216 for each fastener or attachment found in a component during a monitoring process. The detection logic module 300 initiates the plurality of counters 340-349 to incrementally count fasteners detected in a particular process upon the occurrence of a fastening event in a particular component. The detection module 300 enables the process counting sequencing module 220 to read the electrical signals from the fasteners rather then relying on the sensor 215 or 216 to provide the information on the number of fasteners being used at any given time in any given process. In one embodiment, the plurality of counters 340-349 are synchronous counters.

The process specification module 320 stores the fastener or attachment requirements for components for all processes monitored by the automatic process counting monitoring system 200. In one embodiment, the process specification module 320 is capable of storing the fastener requirement information on multiple processes or a single process.

Information from the process specification module 320 is compared by the compare module 320 to real-time fastener count detected by the detection module 300 to determine whether a particular count of the presence of fasteners or attachments for a particular process is achieved. If there is either an over-count or an under-count of fasteners in a particular process, the detection module 300 triggers the alarm module 330 to notify operators of errors in the count of fasteners for a particular process.

In one embodiment of the present invention, operators can reset a count by triggering the plurality of reset modules to reinitiate a process count.

The network connection module 350 includes a plurality of connection pins that allows the remote display units 240-249 to be connected to the automatic process sequencer unit 220. In one embodiment, the network connection module 350 also allows the sensor 216 to be connected to the process sequencer unit 220. In one embodiment, the communication module 350 allows a wireless connection of the sensor 216 and the fastener device tool 210. In another embodiment, the communication module 350 allows the fastener device tool 210 and the external sensor 216 to be networked to the automatic process counting monitoring system 200 by means of a landline network connection.

Figure 4:
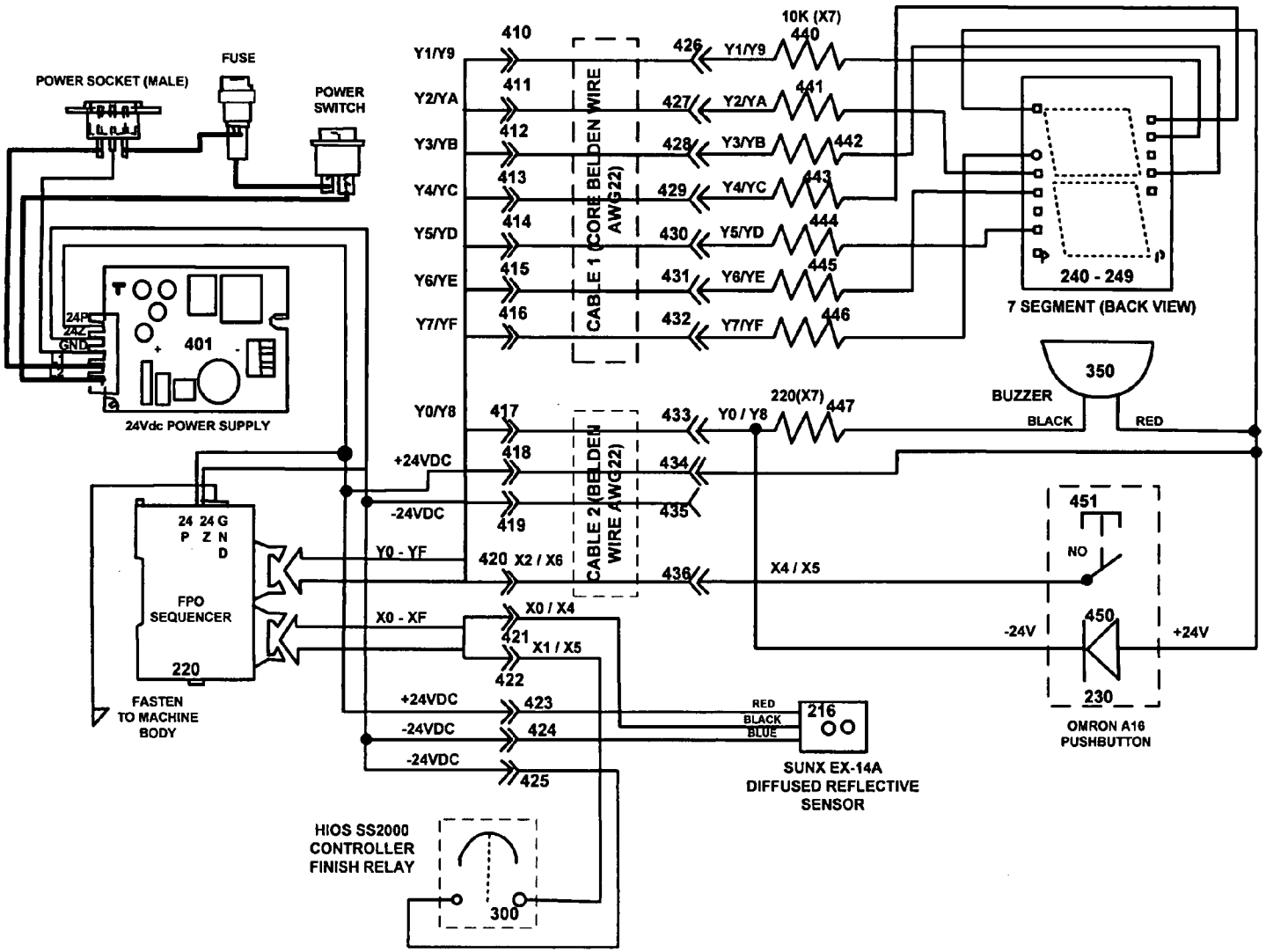
FIG. 4 is a block diagram illustration of the component circuitry of the process counter unit of one embodiment of the invention.

FIG. 4 illustrates one embodiment of the internal circuitry components of one embodiment of the automatic process counting monitoring system 200. As shown in FIG. 4, the logic circuit module 400 comprises a plurality of connectors 410-436, a plurality of current delimiters 440-447. Also illustrated is alarm which comprises an inverter circuit 450 and switch 451.

In one embodiment of the present invention, the sequencer 220 is coupled to the plurality of display units via connectors 410-416 to display the fastener counts to the operator in the manufacturing line. The current delimiters 440-446 provide protection to the display units 240-249.

The alarm unit 330 couples to the sequencer 220 via connectors 417-419 with current delimiters 447 providing protection to the alarm module circuit 330. The reset module coupled to the sequencer 220 via connectors 417-419 with the current delimiter 447 also providing protection to the circuits in the reset module 230.

Figure 5:
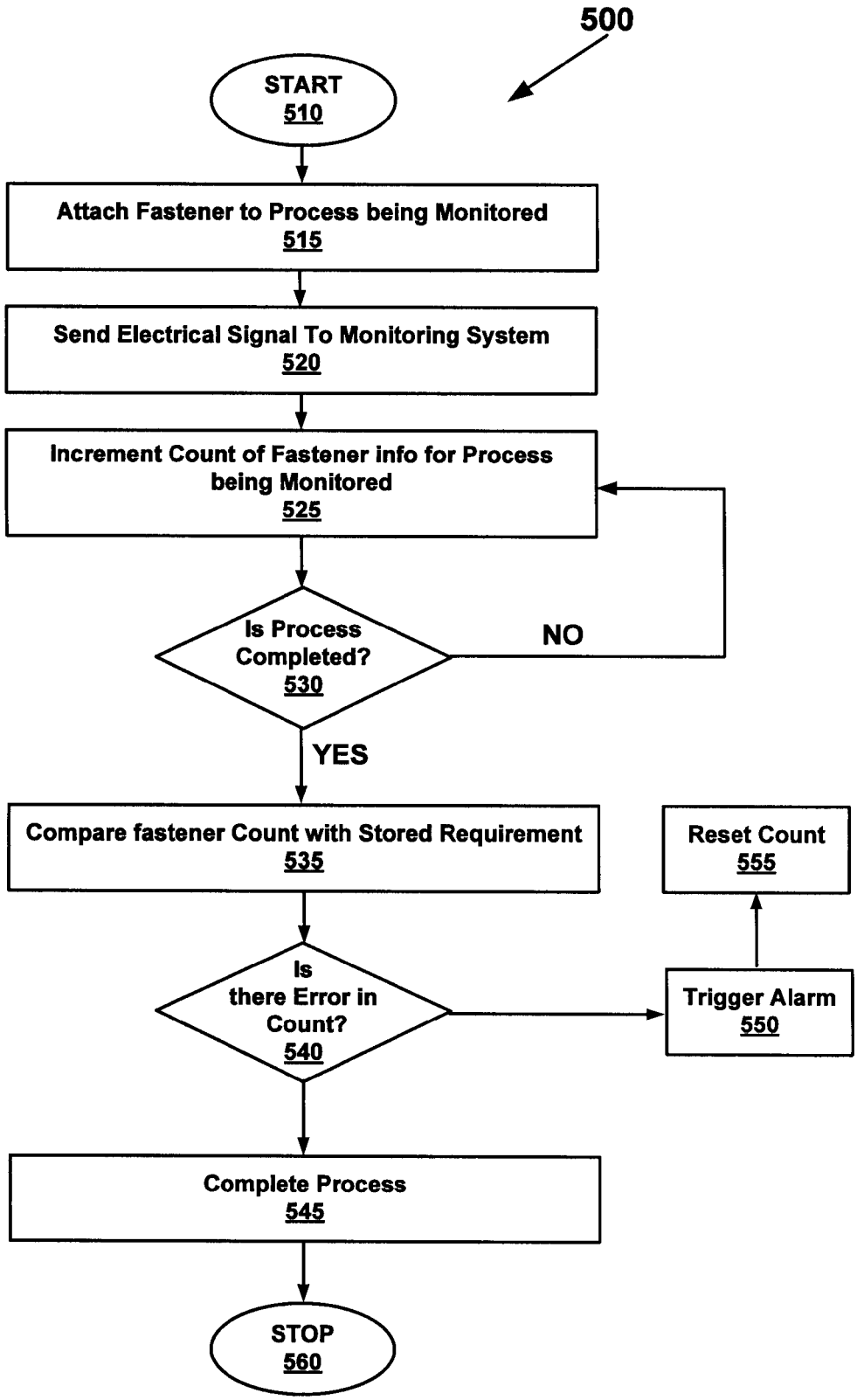
FIG. 5 is a flow diagram illustration of the process counting monitoring system of one embodiment of the invention with a grounding cord.

Referring now to FIG. 5, an exemplary flow diagram of one embodiment of the method of the automatic process counting monitoring system of the present invention in assembling a component or sub-component of a hard disk drive requiring fasteners or attachments is illustrated. As shown in FIG. 5, the process counting monitoring of the present invention starts 510 with the identification of the process to be monitored.

At step 515, fasteners or attachments are attached to the component (process) being monitored with the fastener device tool. At step 520, as each fastener or attachment is attached, electrical signals are sent to the process count sequencer 220 to initiate a count of the fasteners or attachments being attached.

At step 525, the counters designated for the particular process being monitored is incremented by each fastener or attachment attached to the component (process). At step 530, a determination is made as to whether the process is completed or not. If the process is completed, the count of the fasteners or attachments attached are compared with the predefined fastener or attachment requirements for the particular process in step 535. If the process in not completed, the count continues at step 525.

At step 540, a determination is made as to whether there is a error in the count of fasteners or attachments attached to the particular component (process) from comparing the real-time count with the requirements for the component. If there is an error in the real-time count, the detection module triggers the alarm module in step 550 which causes an operator to reset the counter in step 555.

If there is no error in the real-time count, the process is completed in step 545 and the count ends in step 560.

Example embodiments of the present technology are thus described. Although the subject matter has been described in a language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A hard disk drive manufacturing automatic process counter, comprising:

a programmable process counting device for receiving electronic signals from processes or device in the manufacturing line indicating attachment of fasteners or attachments to components or sub-components in the hard disk drive;

a plurality of automatic counters for maintaining a real-time count of the fasteners or attachments for each of the received electronic signals;

a plurality of display devices coupled to the process counting device to display a plurality of process counts to a plurality of operators in the manufacturing line; and a plurality of reset units coupled to the process counting device to reset a count of a particular process when the particular process is determined to have an error in the count of the fasteners or attachments.

2. The hard disk drive manufacturing automatic process counter of claim 1, further comprising a alarm notification device for automatically notifying the plurality of operators of an error in the count of the fasteners or the attachments in a process.

3. The hard disk drive manufacturing automatic process counter of claim 2, further comprising a programmable process specification unit for programming the fastener or the attachment requirements for a plurality of processes utilizing the automatic process counter prior to such processed being implemented in the manufacturing line.

4. The hard disk drive manufacturing automatic process counter of claim 2, further comprising a signal detection unit for detecting a presence of a component or sub-component being processed and the number of fasteners or attachments used during the processing of the component or sub-component.

5. The hard disk drive manufacturing automatic process counter of claim 2, wherein the alarm device is triggered when there is an under-count of the fasteners or the attachments associated with the particular process.

6. The hard disk drive manufacturing automatic process counter of claim 5, wherein the alarm device is further triggered when there is an over-count of the fasteners or the attachments associated with the particular process.

7. The hard disk drive manufacturing automatic process counter of claim 3, wherein the programmable process specification unit is programmed to store information on multiple processes for monitoring by the automatic process counter.

8. The hard disk drive manufacturing automatic process counter of claim 1, wherein the programmable process counting device simultaneously counts the fasteners or attachments of a plurality of components.

9. The hard disk drive manufacturing automatic process counter of claim 1, further comprising a communication interface for enabling the process counting device to receive the plurality of electronic signals corresponding to the processes being monitored.

10. A process monitoring system for automatically counting processes during a hard disk drive manufacturing, comprising:

a process counting device for receiving electronic signals from processes or device in the manufacturing line indicating attachment of fasteners or attachments to components or sub-components in the hard disk drive;

a plurality of automatic counters for maintaining a real-time count of the fasteners or attachments for each of the received electronic signals;

a plurality of display devices coupled to the process counting device to display a plurality of process counts to a plurality of operators in the manufacturing line;

a plurality of reset units coupled to the process counting device to reset a count of a particular process when the particular process is determined to have an error in the count of the fasteners or attachments; and a alarm notification device for automatically notifying the plurality of operators of an error in the count of the fasteners or the attachments in a process.

11. The process monitoring system of claim 10, further comprising a programmable process specification unit for programming the fastener or the attachment requirements for a plurality of processes utilizing the automatic process counter prior to such processed being implemented in the manufacturing line.

12. The process monitoring system of claim 11, further comprising a signal detection unit for detecting a presence of a component or sub-component being processed and the number of fasteners or attachments used during the processing of the component or sub-component.

13. The process monitoring system of claim 10, wherein the alarm device is triggered when there is an under-count of the fasteners or the attachments associated with the particular process.

14. The process monitoring system of claim 13, wherein the alarm device is further triggered when there is an over-count of the fasteners or the attachments associated with the particular process.

15. The process monitoring system of claim 11, wherein the programmable process specification unit is programmed to store information on multiple processes for monitoring by the automatic process.

16. The process monitoring system of claim 10, further comprising a communication interface for enabling the process counting device to receive the plurality of electronic signals corresponding to the processes being monitored.

17. The process monitoring system of claim 12, wherein the signal detection unit comprises a plurality of amplifier circuits.

18. The process monitoring system of claim 17, wherein the plurality of reset units comprise a plurality of inverter circuits.

19. The process monitoring system of claim 18, wherein the plurality of reset units further comprise a plurality of switch circuits.

20. The process monitoring system of claim 19, wherein the notification unit comprise a plurality of light emitting diodes.

21. A method for automatically counting process fasteners during a hard disk drive manufacturing process, the method comprising:

attaching fasteners to manufacturing processes identified for monitoring;

generating electrical signals from the fasteners;

detecting the electrical signals generated;

synchronously counting each electrical signal correspondingly generated for each fastener applied;

displaying the count of the fasteners to a plurality of display devices in a manufacturing line; and generating an alarm signal when the incremental count of the fasteners applied to a particular component does not correspond to a pre-requisite count for the particular component.

* * * * *